US005211742A

United States Patent [19]

Amamoto

[11] Patent Number: 5,211,742

[45] Date of Patent: May 18, 1993

[54] METHOD OF CONVERTING URANIUM DIOXIDE INTO METALLIC URANIUM LUMP

[75] Inventor: Ippei Amamoto, Tomata, Japan

[73] Assignee: Doryokuro Kakunenryo Kaihatsu Jigyodan, Tokyo, Japan

[21] Appl. No.: 739,317

[22] Filed: Aug. 1, 1991

[30] Foreign Application Priority Data

Oct. 22, 1990 [JP] Japan ..... 2-283721

[51] Int. Cl.[5] ..... C22B 60/00

[52] U.S. Cl. ..... 75/399; 75/398

[58] Field of Search ..... 423/5, 253, 261; 75/398, 399, 344

[56] References Cited

U.S. PATENT DOCUMENTS

| | | | |
|---|---|---|---|
| 1,738,669 | 12/1929 | Rich | 75/344 |
| 3,369,889 | 2/1968 | Trent | 75/344 |
| 4,534,792 | 8/1985 | Elliott | 75/399 |
| 4,717,420 | 1/1988 | Duerksen | 75/399 |

OTHER PUBLICATIONS

Preliminary Report, 1990 Fall Meeting of the Atomic Energy Society of Japan, published on Sep. 10, 1990.

Nuclear Chemical Engineering, Second Edition, pp. 274–283, by M. Benedict, T. H. Pigford et al. (1981, published by McGrow Hill Book Company).

The Chemistry of Uranium, pp. 122–131, by J. J. Katz and E. Rabinowich (1951, published by Constable & Co., Ltd.).

*Primary Examiner*—Donald P. Walsh
*Assistant Examiner*—Ngoclan T. Mai
*Attorney, Agent, or Firm*—Wenderoth, Lind & Ponack

[57] ABSTRACT

A method of converting uranium dioxide into a metallic uranium lump is provided The method comprises mixing a reducing agent comprised of metallic calcium, a slag solvent comprised of calcium chloride and a eutectic comprised of at least one member selected from the group consisting of barium chloride, lithium chloride, sodium chloride and potassium chloride into uranium dioxide to obtain a mixture, heating the mixture at a temperature not below the melting point of metallic uranium, separating resulting molten metallic uranium from a resulting molten slag based on a difference in specific gravity, and cooling the molten metallic uranium to produce metallic uranium as a solid lump.

5 Claims, No Drawings

METHOD OF CONVERTING URANIUM DIOXIDE INTO METALLIC URANIUM LUMP

BACKGROUND OF THE INVENTION

The present invention relates to a method of directly producing metallic uranium as a lump by reducing uranium dioxide.

It is known in the art that metallic uranium can be produced by reducing uranium dioxide with metallic calcium according to the following reaction:

$$UO_2+2Ca \rightarrow U+CaO$$

[see "Nuclear Chemical Engineering, Second Edition" pp. 274 -279, by M. Benedict, T. H. Pigford et al. (1981, published by McGrow Hill Book Company)]

However, the melting point of a slag (CaO) as a reaction product is as high as 2572° C., so that it is impossible to separate metallic uranium from the slag by melting and hence metallic uranium can be obtained only in the form of granules scattered in the slag. Accordingly, the metallic uranium granules must be separated out of the slag and the yield of purified metallic uranium is generally about 35 to 40%. Further, there is a drawback that the metallic uranium thus separated is susceptible to oxidation and is difficult to handle because it is granular.

Moreover, it is known to add calcium chloride in the above-described reaction in which uranium dioxide is reduced with metallic calcium [see "The Chemistry of Uranium", pp. 122-132, by J. J. Katz and E. Rabinowich (1951, published by Constable & Co., Ltd.)]. The addition of calcium chloride facilitates the reduction reaction, but the formation of granulated metallic uranium scattered in the slag and hence the recovery of granulated metallic uranium are inevitable.

SUMMARY OF THE INVENTION

Accordingly, an object of the present invention is to provide a method of reducing uranium dioxide improved so as to obtain metallic uranium as a lump, in place of obtaining a product having granulated metallic uranium scattered in the slag as in the above-described conventional methods, in the manufacturing of metallic uranium by reducing uranium dioxide with metallic calcium.

The method of converting uranium dioxide into a metallic uranium lump according to the present invention comprises mixing a reducing agent comprised of metallic calcium, a slag solvent comprised of calcium chloride and a eutectic comprised of at least one member selected from the group consisting of barium chloride, lithium chloride, sodium chloride and potassium chloride into uranium dioxide to obtain a mixture, heating the mixture at a temperature not below the melting point of metallic uranium, separating resulting molten metallic uranium from a resulting molten slag based on a difference in specific gravity, and cooling the molten metallic uranium to produce metallic uranium as a solid lump.

Uranium dioxide reacts with metallic calcium as a reducing agent according to the following formula:

$$UO_2+2Ca \rightarrow U+2CaO,$$

thereby forming metallic uranium and a slag (CaO). As described above, the slag per se has a melting point as high as about 2572° C., which comes to dissolve, however, at about 500° C. in the presence of calcium chloride, which is a solvent for the slag, along with a eutectic. This permits the effective utilization of the heat generated in the reduction reaction according to the above-described formula for the dissolution of the slag. As a result, the formed metallic uranium and slag are brought to a molten state, so that a resulting molten metallic uranium phase is separated from a resulting molten slag phase by a difference in specific gravity. By cooling the separated uranium phase, it is possible to form a metallic uranium lump on the bottom of the container.

Since the use of a slag solvent and a eutectic in combination serves to lower the viscosity of molten slag, an effective separation of a molten metallic uranium phase is expected.

PREFERRED EMBODIMENTS OF THE INVENTION

One member or a mixture of at least two members selected from barium chloride ($BaCl_2$), lithium chloride (LiCl), sodium chloride (NaCl) and potassium chloride (KCl) may suitably be used as the eutectic in the present invention. The melting point of a slag solvent/eutectic mixture may be varied by the use of a mixture of calcium chloride ($CaCl_2$) as a slag solvent and a plurality of co-fluxes made in various mixing proportions. Representative examples of mixture compositions are shown below. The values in parentheses represent the mixing proportions of individual components in wt. %.

| Mixture composition | Melting point (°C.) |
|---|---|
| $CaCl_2$—LiCl—NaCl—$BaCl_2$ (10.6:41.1:8.9:39.4) | 490 |
| $CaCl_2$—NaCl—$BaCl_2$ (47.0:38.0:15.0) | 340 |
| $CaCl_2$—LiCl—$BaCl_2$ (28.8:54.1:17.1) | 406 |
| $CaCl_2$—LiCl—NaCl (34.2:52.3:13.5) | 440 |
| $CaCl_2$—KCl—NaCl (50.0:7.3:42.7) | 465 |
| $CaCl_2$—KCl—LiCl (5.0:43.0:52.0) | 340 |

In the present invention, it is preferred that the melting point of a slag solvent/eutectic mixture do not exceed about 500° C.

The amount of metallic calcium added as a reducing agent preferably ranges from 1.1 to 1.2 equivalents per equivalent of uranium dioxide. When the amount is below the above-described range, no effective reduction can be attained. On the other hand, when it is in excess, the heat generated in the reduction reaction is unfavorably consumed up by the melting and evaporation of excess reducing agent.

The amount of the added slag solvent/eutectic mixture is preferably 60% by weight or more based on the amount of slag formed by the reaction When the amount is less than this, the dissolution of the slag into the mixture is likely to become insufficient.

In practising the method of the present invention, first, uranium dioxide, a slag solvent and a eutectic are dried to such an extent that powder rendered as anhydrous as possible is obtained, and a surface oxide film is removed from metallic calcium as a reducing agent. Subsequently, the thus treated raw materials are mixed together homogeneously and forced into a crucible. The crucible is disposed in a heating oven and heated in an inert gas atmosphere under an atmospheric or reduced pressure. In the heating, gradual heating while paying attention for uniform heating is effected up to a temperature just below about 500° C. at which reduction reaction occurs in order to avoid heat loss, and thereafter rapid heating is effected within a short period of time up to the melting point (1133° C.) of uranium or above. Upon the completion of the reaction, the crucible is taken out of the oven, the molten slag and metallic uranium in the crucible are immediately cooled, and the metallic uranium lump formed on the bottom of the crucible is taken out.

When the heat insulation effect of a heating apparatus is not appropriate, according to necessity, it is preferred to add iodine to the raw material mixture. This permits the utilization of the heat generated by the reaction between iodine and calcium for the melting of metallic uranium and slag formed by the reduction reaction, thereby compensating for the shortage in heat quantity. In this case, the amount of added iodine is within 10% by weight based on the weight of uranium dioxide.

EXAMPLE 1

| | | |
|---|---|---|
| uranium dioxide | | 50 g |
| metallic calcium (reducing agent) | | 17.1 g |
| calcium chloride (slag solvent) | | 1.33 g |
| co-flux | LiCl (eutectic) | 5.14 g |
| | NaCl (eutectic) | 1.11 g |
| | $BaCl_2$ (eutectic) | 4.92 g |

These raw materials were mixed together homogeneously and forced into a crucible. The crucible was disposed in a heating oven, and heated to about 500° C. in an argon atmosphere under an atmospheric pressure over a period of an hour. Subsequently, the crucible was heated to 1500° C. over a period of 15 min. The crucible was taken out of the oven and immediately cooled to thereby solidify the melt formed in the crucible. Thereafter, 33.4 g of a metallic uranium lump formed on the bottom of the crucible was collected. The yield of the metallic uranium lump was 75.8%.

EXAMPLE 2

| | | |
|---|---|---|
| uranium dioxide | | 50 g |
| metallic calcium (reducing agent) | | 17.7 g |
| calcium chloride (slag solvent) | | 1.65 g |
| co-flux | LiCl (eutectic) | 6.40 g |
| | NaCl (eutectic) | 1.38 g |
| | $BaCl_2$ (eutectic) | 6.13 g |
| iodine | | 3.5 g |

These raw materials were mixed together homogeneously and forced into a crucible. The crucible was subjected to the same procedure as that described in Example 1, thereby obtaining 35.3 g of a metallic uranium lump. The yield of the metallic uranium was 80.0%.

As is apparent from the foregoing, according to the present invention, it is possible to dissolve at 500° C. a slag (CaO), which generally melts only at a temperature as high as about 2572° C., by the use of a slag solvent and a eutectic in combination.

Therefore, the heat generated by the reduction reaction of uranium dioxide can effectively be used for the melting of reaction products and, as a result, molten slag and metallic uranium are obtained as products and a molten metallic uranium phase is separated from a molten slag phase based on a difference in specific gravity. By cooling the separated uranium phase, it is possible to directly produce a metallic uranium lump.

What claimed is:

1. A method of converting uranium dioxide into a metallic uranium lump, comprising mixing a reducing agent comprised of metallic calcium, a slag solvent comprised of calcium chloride and a eutectic comprised of at least one member selected from the group consisting of barium chloride, lithium chloride, sodium chloride and potassium chloride into uranium dioxide to obtain a mixture, heating the mixture at a temperature not below the melting point of metallic uranium, separating resulting molten metallic uranium from a resulting molten slag based on a difference in specific gravity, and cooling the molten metallic uranium to produce metallic uranium as a solid lump.

2. The method according to claim 1, wherein the slag solvent is mixed into uranium dioxide in an amount of 1.1 to 1.2 equivalents per equivalent of uranium dioxide.

3. The method according to claim 1, wherein a mixture of the slag solvent and the eutectic is mixed into uranium dioxide in an amount of 60% by weight or more based on the amount of the resulting slag.

4. The method according to claim 1, wherein said heating step is carried out by gradually heating said mixture up to a temperature just below about 500° C. and then rapidly heating said mixture up to the melting point of metallic uranium or above.

5. The method according to claim 1, wherein iodine is further mixed into uranium dioxide.

* * * * *